United States Patent [19]

Wernet et al.

[11] 4,242,543

[45] Dec. 30, 1980

[54] MULTIPLE CANTILEVER SPRING CONTACT HOOK SWITCH

[75] Inventors: William F. Wernet, Nashville; William J. Adams, Franklin; Steve W. Haskins, Laverne, all of Tenn.

[73] Assignee: Northern Telecom, Inc., Ottawa, Canada

[21] Appl. No.: 66,408

[22] Filed: Aug. 14, 1979

[51] Int. Cl.[3] ..... H01H 1/28

[52] U.S. Cl. ..... 200/1 A; 200/6 R; 200/6 BB; 200/283; 200/DIG. 46

[58] Field of Search ..... 200/283, 1 TK, 1 A, 200/6 B, 6 BB, 5 R, DIG. 46, 6 R; 179/158 R, 159, 160, 162, 164, 165

[56] References Cited

U.S. PATENT DOCUMENTS

| | | | |
|---|---|---|---|
| 2,765,381 | 10/1956 | Smith | 200/283 |
| 3,073,911 | 1/1963 | Mattke et al. | 179/159 |
| 3,242,273 | 3/1966 | van der Put | 200/303 |
| 3,916,119 | 10/1975 | Gumb et al. | 179/164 |
| 4,091,244 | 5/1978 | Chu et al. | 200/6 BB |

*Primary Examiner*—John W. Shepperd

*Attorney, Agent, or Firm*—Schwartz, Jeffery, Schwaab, Mack, Blumenthal & Koch

[57] ABSTRACT

A multiple cantilever spring contact switch has a plurality of cantilever spring contacts, in one or more series, with the contacts of each series clamped between surfaces which provided a predetermined relative inclination of the contacts. A pivotal member is mounted on the switch assembly for actuation by an operating member, the pivotal member in turn actuating the contacts. The contact between operating member and pivotal member is localized so that misalignment between operating member and the switch assembly does not affect actuation of the contacts. Such misalignment can occur when the switch assembly or operating member or both are mounted on printed circuit boards. The switch is particularly suitable for a hook switch of a telephone.

16 Claims, 19 Drawing Figures

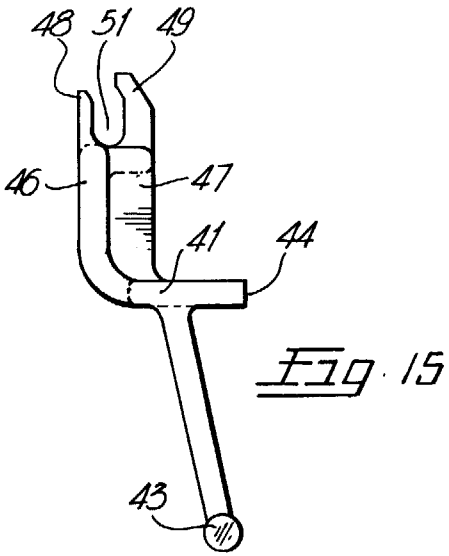
Fig. 16.
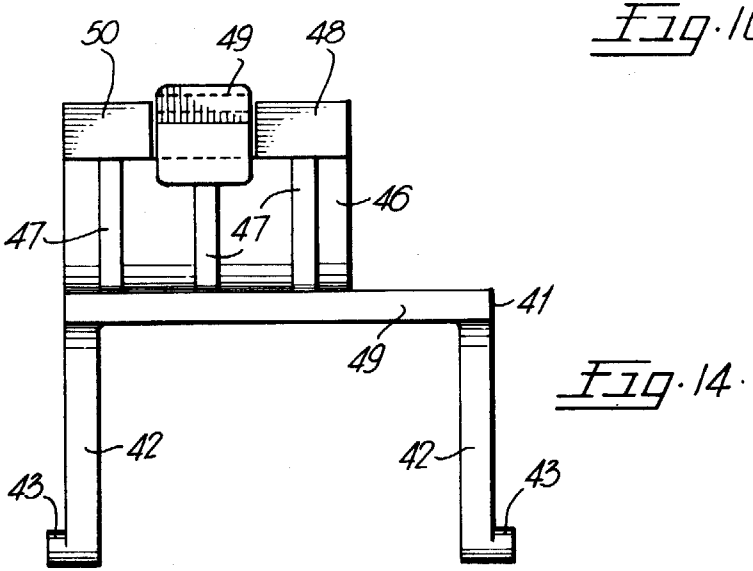
Fig. 15
Fig. 14.

MULTIPLE CANTILEVER SPRING CONTACT HOOK SWITCH

This invention relates to multiple cantilever spring contact switches, in which a plurality of series of spring contact members are arranged side-by-side, and is particularly applicable to hook switches for telephones and similar switches.

In many forms of cantilever spring contact switches, such as are used for hook switches for telephones, a plurality of cantilever contact members are stacked, that is assembled one on top of another, and switch contacts are made and broken by flexing of one or more of the spring contact members relative to others in the stack or pile. Such an arrangement requires very accurate positional relationship between the spring contact members.

In co-pending application entitled "Multiple Cantilever Spring Contact Switches", in the names of S. A. Croft, B. J. Dolan, and P. J. Chu, although a number of spring contact members are effectively stacked, the clamped ends of the contact members are held in grooves in a mounting assembly, the grooves having base surfaces which are inclined relative to each other so as to impose predetermined angular inclinations to the contact members. Such an arrangement urges the cantilever spring contact members into the correct positional relationship as the switch is assembled. In a particular arrangement the individual contact members are positioned side-by-side at their mounting positions, the ends of one of more contact members remote from the mounting position being extended laterally so that the free ends of the contact members overlie each other. Such an arrangement has proved very effective when the actuating member which actuates the contact members and the spring contact assembly are mounted on substantially rigid portions of a telephone set, the portions being at all times in the same relative position. However, with the use of printed circuit boards (PCB's) and the mounting of certain items such as the contact member assembly on one PCB, and possibly the actuating member on another PCB, there often occurs malalignment between the actuating member and the contact members. Thus the actuating member may be inclined relative to the contact member assembly and only some of the contact members actuated.

In the present invention, in a multiple cantilever spring contact switch, as described in the previous paragraph and in the aforementioned application, a pivotal member is provided which is pivotally mounted on the switch assembly, with the member having a projection for actuating the contact members and a formation of limited intent which is engaged by the switch operating member. There is provided a localized contact between pivotal member and the switch operating member which results in arcuate movement of the pivotal member. The arcuate movement is always in a predetermined relationship to the contact members and is completely independent of the alignment between the switch operating member and the pivotal member.

The invention will be readily understood by the following description in conjunction with the accompanying drawings, in which:

FIGS. 14, 15 and 16 are bottom plan view, side view and end view respectively of the pivotal member of FIG. 13;

Figure 1:
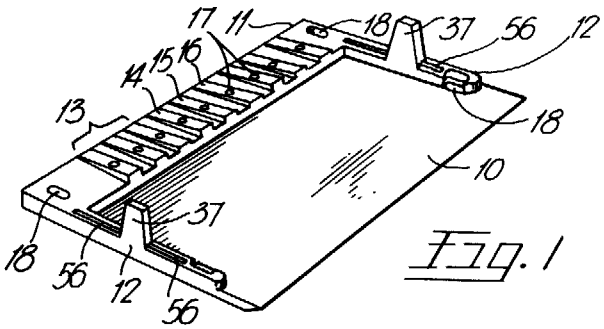
FIG. 1 is a perspective view of one part of a two part mounting assembly for the contact members.
Figure 3:
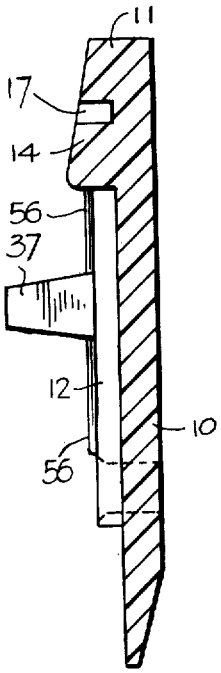
FIGS. 3, 4 and 5 are cross-sections on the lines III—III, IV—IV and V—V respectively of FIG. 2.
Figure 4:
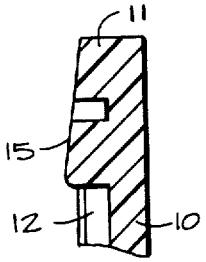
Figure 5:
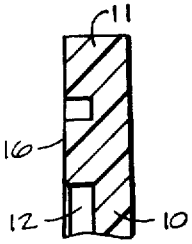
Figure 8:
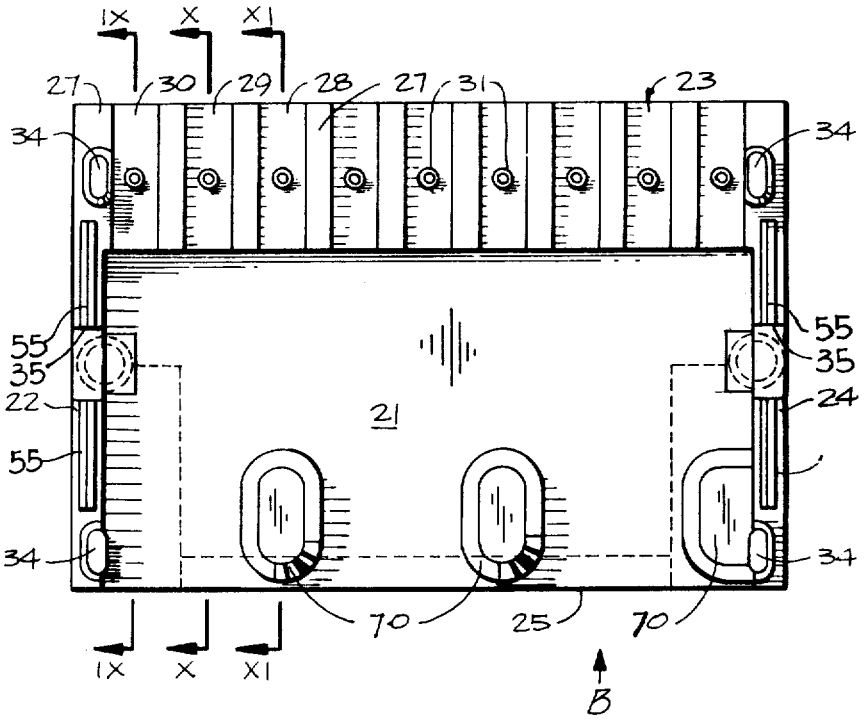
FIG. 8 is a plan view of the part of FIG. 7.

The mounting assembly, in the embodiment illustrated, comprises two parts, for convenience referred to as a base and a top spaced to define a contact enclosure, and a pivotal member attached to the parts. The top illustrated in FIGS. 1 to 6, comprises a flat planar web 10 having a raised rim 11 along one edge and ribs 12 along each side. The raised rim carries a plurality of protrusions arranged in series. In the example illustrated three series of protrusions are provided, each series comprising three protrusions having inclined surfaces. Thus, as seen in FIG. 1, a series is indicated at 13, and the protrusions at 14, 15 and 16. A small hole 17 is formed in the rim 11 at each protrusion 14, 15 and 16 for reception of a locating pin on the base. The protrusions 14, 15 and 16 have inclined top surfaces, and in the example illustrated in FIGS. 1 to 6, protrusion 14 is inclined upwardly at a greater angle than the protrusion 15 and 15 is at a greater angle than 16. At each series 13 there is provided three positions at 14, 15 and 16, and a cantilever spring contact member is mounted at each position, as will be described. The relative angular dispositions of the surfaces 14, 15 and 16 at the various positions are clearly seen in FIGS. 3, 4 and 5 respectively.

Recesses 18 are formed at each side for reception of small protrusions on the base, for alignment, as will be described.

Figure 7:
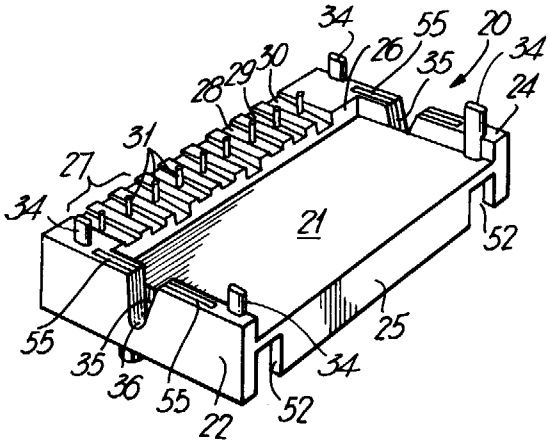
FIG. 7 is a perspective view of the other part of the mounting assembly, upside down relative to the part of FIG. 1.
Figure 12:
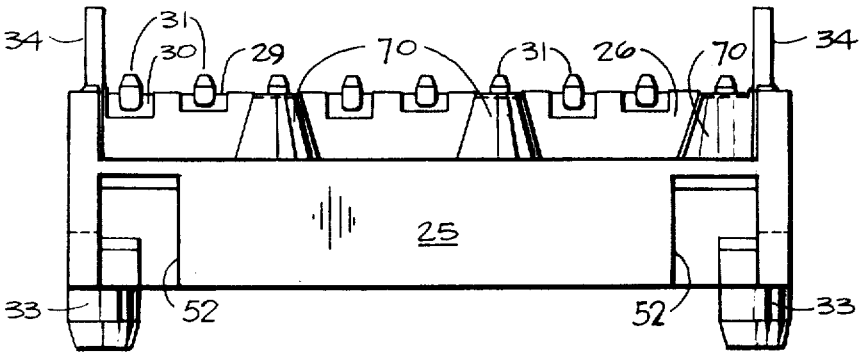
FIG. 12 is a view in the direction of arrow B in FIG. 8.
Figure 11:
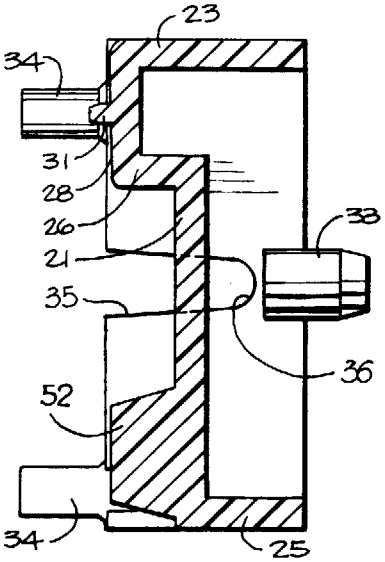
FIGS. 9, 10 and 11 are cross-sections on the lines IX—IX, X—X, and XI—XI respectively of FIG. 8.
Figure 10:
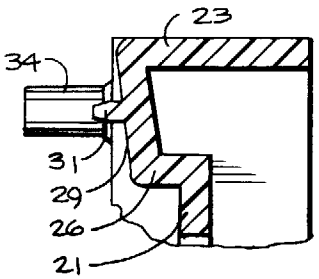
Figure 9:
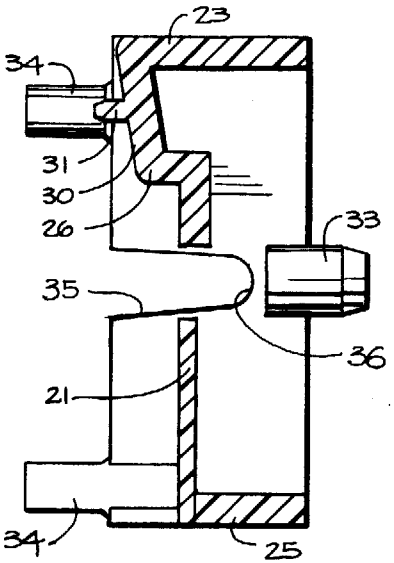

The base is illustrated in FIGS. 7 to 12 and comprises a box-like member 20 having an intermediately positioned web 21 and four side members 22, 23, 24 and 25. Side members 22, 23 and 24 extend both sides of the web 21 while side 25 extends only on one side. Adjacent to the side member 23, a raised portion or rim 26 extends longitudinally. This can be formed by a localized thickening of the web 21, but in the example illustrated is formed by in effect, raising the web adjacent to the side member 23. This raised portion 26 is formed to give a number of recesses arranged in series. In the example, three series each of three recesses, are provided to cooperate with the positions on the base. In FIG. 7 a series is indicated at 27 and a series comprises recesses 28, 29 and 30. Recess 28 is, only slightly inclined, recess 29 more inclined than 28 and 30 more inclined than recess 29. A pin 31 is formed at each recess. Extending from the side members 22 and 24, in a direction opposite to that in which the recesses face, are two pins 33 which can be provided for locating the switch assembly on a circuit board or other member. Four protruding lugs 34 extend upwards, as seen in FIG. 12, these protrusions entering the recesses 18 in the top.

The inclination of the base surfaces of the recesses 29 and 30 matches the inclination of the surfaces of the protrusions 15 and 14 respectively. The pins 31 fit into the holes 17, and the side members 22 and 24 abut ribs 12 and 10 respectively, when assembled.

Formed in the side members 22 and 24 of the base 20 are two slots 35. Slots 35 extend down below the level of the web 21 and have substantially semi-cylindrical ends 36. Extending upward from the rib 12 along each side of the top are protrusions 37. The positioning and dimensions of the protrusions 37 are such that they enter the slots 35 when the top and base are assembled together. When so assembled, there is left a small gap between the end of each protrusion 37 and the semi-cylindrical ends 36 of slots 35, for pivotal mounting of a member as illustrated in FIGS. 13, 14, 15 and 16.

Figure 13:
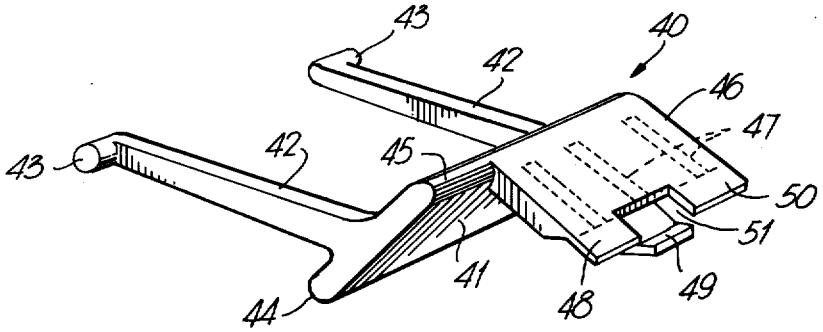
FIG. 13 is a perspective view of the pivotal member.

FIG. 13 is a perspective view of the pivotal member 40 which has a lateral web 41 from one side of which project two spaced apart parallel legs 42. At the ends of the legs 42 are outwardly extending cylindrical bosses 43, one on each leg. The bosses 43 are of a dimension to fit in the semi-cylindrical ends 36 of the slots 35 in the base and the legs 42 are spaced apart such they slide readily between the sides 22 and 24 of the base. The lateral web 41 has a longitudinally extending base edge 44. From the top edge 45 extends a flange 46, flange 46 only extending, in the example illustrated, for a part of the length of the web 41. The flange 46 has a plurality of stiffening ribs 47 and at its end remote from the web 41 is divided into three sections 48, 49 and 50. The outer sections 48 and 50 are continuations of the main body of the flange 46, but being reduced in thickness as seen in FIG. 13. The centre section 49 is at a lower level than sections 48 and 50, as seen in FIGS. 13 and 15 and this provides a gap 51 into which an operating member can fit.

The pivotal member 40 is attached to the base by squeezing the legs 42 together at their free ends and inserting the bosses 43 into the ends of slots 35. The pivotal member is positioned on the other side of the intermediate web 21 of the base. The protrusions 37 on the top extend down into the slots 35 and provide, with the semi-cylindrical ends 36, a journal for the pivoting of the bosses 43. The legs 42 extend through slots 52 in the side 25 of the base.

The contact members are positioned on the base by positioning a contact member in each recess 28, 29 and 30. Holes in the contact members fit over the pins 31 to provide correct positioning. The top is then applied. The top and base are held tightly together while bonded together. Such bonding can be by an adhesive, by sonic bonding or welding, or by any other convenient and suitable method. In the example illustrated, Vee shaped ribs 56 are formed on the ribs 12 and Vee grooves 55 on side members 22 and 24, for sonic welding of top and base. This clamps one end of each cantilever spring contact member between two surfaces, one on the base and one on the top. The inclination of the surfaces of the recesses and protrusions constrains the contact members at their fixed ends to a particular relative inclination.

The particular form of switch assembly illustrated is a transfer type, in that contact of a central contact member is transferred from a contact member on one side to a contact member on the other. Other types of switches can be provided. Actuation of the contacts in the example illustrated, is by the pivotal member 40 which in turn is actuated by the operating member 60 illustrated in FIG. 17, and is also seen in the completely associated switch in FIG. 18.

Figure 17:
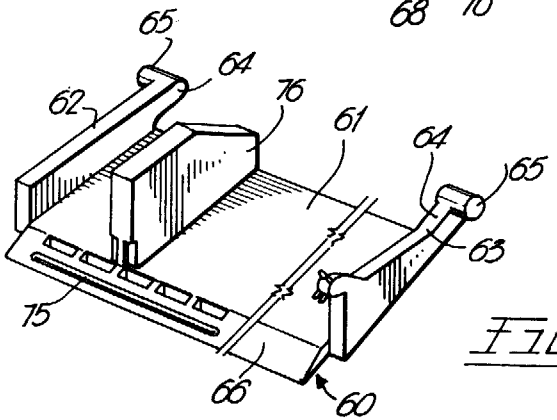
FIG. 17 is a perspective view of the switch operating member for moving the pivotal member.

As illustrated in FIG. 17, the lever is upside down as compared with the switch assembly. The operating member indicated generally at 60, comprises a flat web 61 with flanges 62 and 63, one at each end. At the rear ends of the flanges are extensions 64 carrying cylindrically shaped members 65. Members 65 are in axial alignment and provide for pivotal mounting of the lever 60. The forward edge 66 of the web 61 extends forward of the flanges and is tapered.

Figure 18:
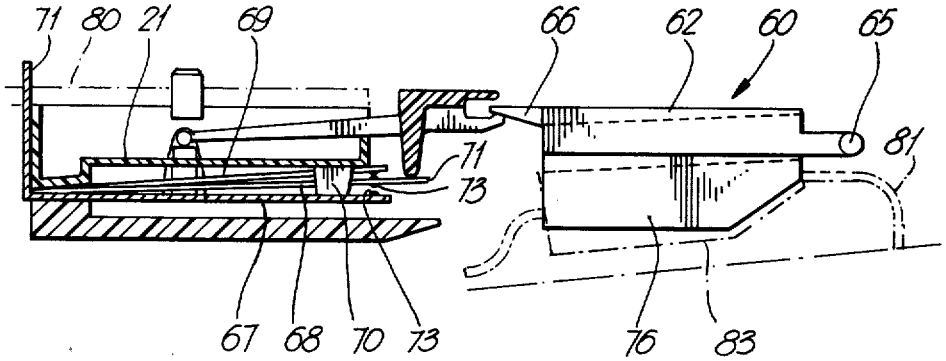
FIG. 18 is a cross-section through an assembled switch and including the operating member.

The cooperating of the various members is illustrated in FIG. 18. The cantilever spring contact assembly would be mounted on a, for example, printed circuit board, indicated in dotted outline at 80. The pivotal member is pivotally mounted in the spring contact assembly with the edge 44 resting on or in close association with the extended portions 71 of the spring contacts 68. The tapered forward edge 66 of the operating member 60 is positioned in the gap 51, that is between the outer portions 48 and 50 and the inner portion 49 of the flange 46 of the pivotal member. In a normal telephone installation the operating member 60 would be biased downward, as illustrated in FIG. 18, by a spring, not shown. The whole assembly of FIG. 18 would the other way up in a desk telephone and rotated through 90° for a wall telephone. The flange 76 would project through the housing of the telephone set, for example through the base of a recess for receiving one end of the handset, as indicated in dotted outline at 81. The position of the flange 76, in an "off-hook" condition, that is with the handset removed, is indicated in chain dotted outline at 83.

It will be seen that contact only occurs between the operating lever 60 and the centre portion 49 when the operating member moves to an "off-hook" condition. This is when the spring contacts are actuated from their "normal" or "on-hook" positions. As this contact between the lever 60 and the portion 49 is localized, lack of alignment between lever 60 and the spring contact assembly will not affect the actuation of the spring contacts. The pivotal member at all times moves about an axis parallel to the plane of the contact extensions 71.

FIG. 18 also illustrates the relative positioning of the cantilever spring contact members, indicated at 67, 68 and 69, the pivotal member 40 and the operating member 60. Contact member 67 is held between the surface at position 16 and the base surface 28, contact member 68 is held between the inclined surface of protrusion 15 and the base surface of recess 29, and contact member 69 is held between the inclined surface of protrusion 14 and the base surface of recess 30. In the example, to provide correct positioning of contact member 67, bosses 70 are formed on the web 21, aligned with each surface 28. The contact members 67 rest on the bosses. The provision of the bosses 70, provides some override action. Contact member 69 is constrained to contact the surface of the intermediate web 21 and contact 66 is constrained to an intermediate position. This is seen in FIG. 18.

Figure 19:
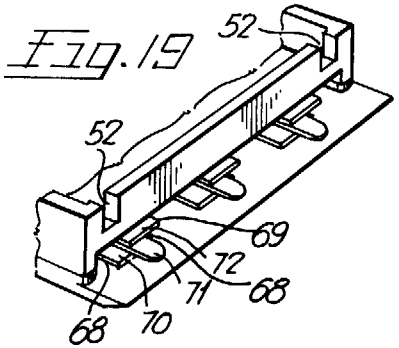
FIG. 19 is a perspective view of the forward end of an assembled base and top with contacts but with the pivotal member omitted for clarity.
Figure 2:
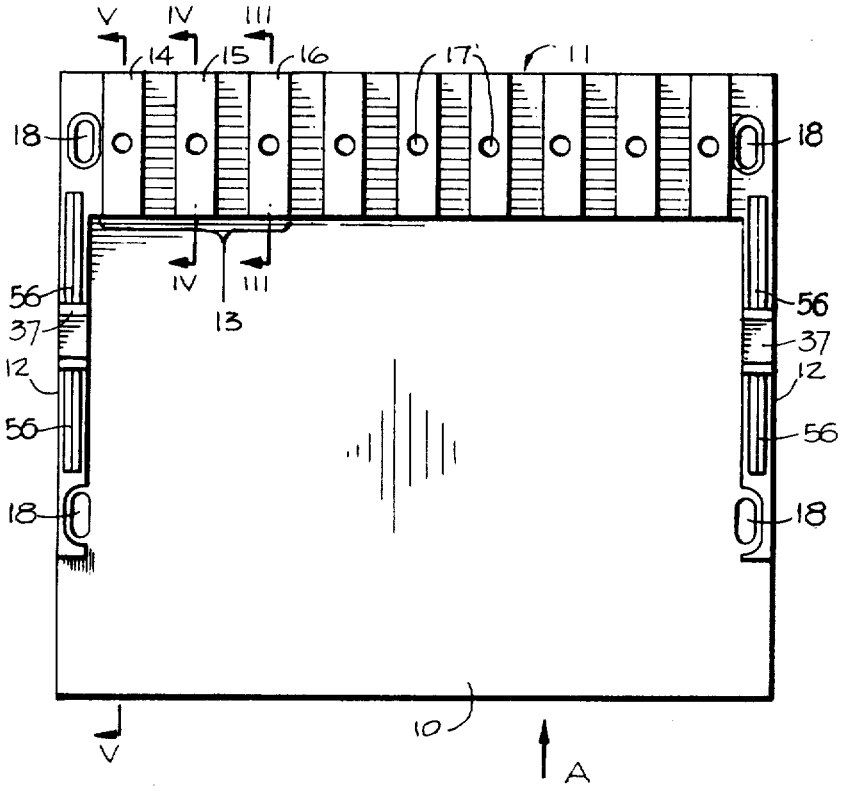
FIG. 2 is a plan view of the part in FIG. 1.
Figure 6:
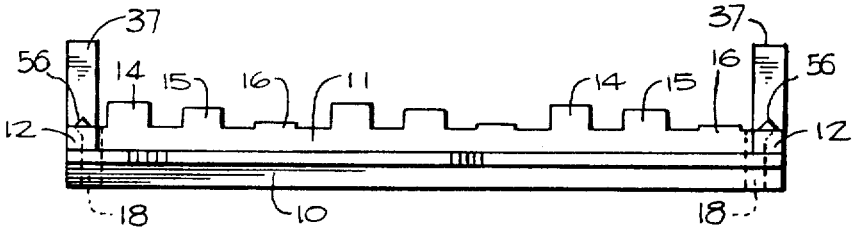
FIG. 6 is a view in the direction of arrow A in FIG. 2.

As illustrated in FIG. 19, the free ends of contact members 67 and 69 are extended laterally towards the contact member 68, the extended end 70 of contact member 67 underlying the free end 71 of contact member 68 and the extended end 72 of contact member 69 overlying the free end 71 of contact member 68. Localized dots of contact metal 73 are provided at the free end of each contact member to improve contact characteristics. To improve contact point alignment the dots can be circular on contact members 67 and 69 and lateral bars on contact member 68. The contact members 67, 68 and 69 are also provided with tails or extensions 71 for attachment of conductors. Depending upon the particular use of the switch, the extensions 71 can be reduced in width at their ends to pass through holes in a circuit board. The ends can then be soldered to the circuit pattern on the board. However other ways of connecting electrical conductors to the cantilever spring contact members can be provided.

With variations in design, variations in switching sequences can be obtained. Thus the edge 44 can be stepped to provide sequential switching. While illustrated in the form of a transfer switch arrangement, straight forward make or break formations can be provided. While three series of contact members have been illustrated, larger or smaller numbers of series can be provided, down to one series. Similarly, more or less than three contact members can be provided for each series, and each series of contact members does not necessarily have the same number of contact members.

What is claimed is:

1. A multiple cantilever spring contact switch comprising:

a base and a top, each having a planar web, the webs spaced apart to define a contact enclosure;

a rim along one edge of each of said base and top, said rims in opposition;

clamping surfaces at said rims;

cantilever spring contact members clamped at one end between said clamping surfaces, said clamping surfaces inclined relative to each other whereby said contact members extend at different inclinations across said enclosure, electrically isolated from each other, said spring contact members and said base and top forming a switch assembly;

contact positions at free ends of said contact members, one of said contact members extended at said free end beyond said enclosure for actuation thereof;

means for connecting an electrical conductor to each contact member; and a pivotal member pivotally mounted on said switch assembly, said pivotal member including a projecting member having an edge positioned in actuating-relationship to said free ends of said extended contact members, and localized means on said pivotal member for contact with an operating member whereby movement of said operating member pivots said pivotal member to actuate said contact members, actuation of said extended contact members changing contact conditions between said contact members.

2. A switch as claimed in claim 1, said clamping surfaces spaced apart along each of said rims, to form at least one series of clamping positions, the clamping surfaces of a series inclined relative to each other in opposed pairs, a contact member between each pair of clamping surfaces.

3. A switch as claimed in claim 1, said pivotal member comprising:

a laterally extending web;

a pair of spaced apart legs extending from one side of said laterally extending web;

a boss extending laterally from each leg at an end thereof remote from said laterally extending web;

journal means on said switch assembly, said bosses extending from said legs pivotally supported in said journal means;

said edge positioned in actuating relationship to said free ends of said extended contact members constituting an edge on said laterally extending web.

4. A switch as claimed in claim 3, said base comprising a box-like member having side members extending from said planar web in a direction opposite to said rim, the rim extending along one edge, and a side member along each side, the side members along each side also extending from said planar web in the same direction as said rim;

said top including ribs extending from said planar web, along each side thereof, the ribs extending in the same direction as said rim;

said ribs and said side members along each side of said base in opposition and defining three sides of said contact enclosure, the fourth side of said enclosure open.

5. A switch as claimed in claim 4, said pair of spaced legs spaced apart a distance to fit between said side members of said base on the side of said planar web opposite to that of said rim, said journal means formed in said side members.

6. A switch as claimed in claim 5, said journal means comprising a slot in each of said members and extending from an edge opposed to said top, said slots extending beyond said planar web; and protrusions on said top extending into said slots, an end of each protrusion spaced from an end of a related slot.

7. A switch as claimed in claim 3, said pivotal member including a flange extending in a direction opposite to the direction of said legs, said flange extending for a portion of the length of said laterally extending web, said flange adapted for contact with said operating member.

8. A switch as claimed in claim 7, said flange divided into three sections side-by-side in said laterally extending web and forming a centre section and an outer section on each side of said centre section, the centre section being displaced, relative to said outer sections, in a direction normal to the plane of said flange to define a gap, for reception of said operating member.

9. A switch as claimed in claim 4, said series of clamping surfaces comprising recesses in said rim of said base and protrusions on said rim of said top.

10. A switch as claimed in claim 4, each said series of clamping surfaces comprising at least three pairs of opposed clamping surfaces positioned side-by-side, each pair inclined relative to each other pair.

11. A switch as claimed in claim 4, each said series of clamping surfaces comprising at least three pairs of opposed clamping surfaces positioned side-by-side in sequence, the pairs of clamping surfaces at successively increased inclination.

12. A switch as claimed in claim 4, each said series of clamping surfaces comprising at least three pairs of opposed clamping surfaces positioned side-by-side, a first one of said contact members being extended at said free end, each of the other contact members including a lateral extension at said free ends, said lateral extensions extending in overlapping relationship with said free end of said first one, said extension of said free end of said first one of said contact members extending beyond said external extensions on said other contact members.

13. A switch as claimed in claim 12, said series of clamping surfaces comprising recesses in said rim of said base and protrusions on said rim of said top.

14. A switch as claimed in claim 12, said first one of said contact members positioned intermediate the other contact members.

15. A switch as claimed in claim 14, a series of said contact members comprising a bottom contact member, an intermediate contact member and a top contact member, the bottom contact member adjacent to said base and said top member adjacent to said top.

16. A switch as claimed in claim 15, including bosses formed on said planar web of said base, said bosses extending towards said top, said bosses in contact with and biasing said top contact member to a predetermined position.

* * * * *